US005526464A

United States Patent [19]

Mermelstein

[11] Patent Number: 5,526,464

[45] Date of Patent: Jun. 11, 1996

[54] REDUCING SEARCH COMPLEXITY FOR CODE-EXCITED LINEAR PREDICTION (CELP) CODING

[75] Inventor: Paul Mermelstein, Cote St. Luc, Canada

[73] Assignee: Northern Telecom Limited, Montreal, Canada

[21] Appl. No.: 53,754

[22] Filed: Apr. 29, 1993

[51] Int. Cl.[6] ..... G10L 3/02; G10L 9/00

[52] U.S. Cl. ..... 395/228; 395/2.32

[58] Field of Search ..... 395/2.28, 2.32, 395/2.34, 2.29, 2.71, 2.21; 381/31–38

[56] References Cited

U.S. PATENT DOCUMENTS

| | | | |
|---|---|---|---|
| 4,811,398 | 3/1989 | Coppieri et al. | 381/37 |
| 4,949,383 | 8/1990 | Koh et al. | 381/31 |
| 5,179,594 | 1/1993 | Yip et al. | 381/40 |
| 5,223,660 | 8/1993 | Chen | 381/38 |
| 5,233,660 | 8/1993 | Chen | 381/38 |
| 5,327,520 | 7/1994 | Chen | 395/2.28 |
| 5,371,853 | 12/1994 | Kao et al. | 395/2.32 |

OTHER PUBLICATIONS

Sub–Band Coding of HDTV Images Using GQMF Al–Asmari, IEEE/Jul. 1992.

*Primary Examiner*—Allen R. MacDonald
*Assistant Examiner*—Richemond Dorvil
*Attorney, Agent, or Firm*—Dallas F. Smith; John A. Granchelli

[57] ABSTRACT

A code-excited linear prediction (CELP) coding method and code divide the residual signal into frequency bands. Codebooks provided for each band decrease in size with increasing band frequency. Reduction in codebook size with increasing frequency together with reduction in sampling rate with decreasing frequency provide reductions in codebook search complexity that allow real time implementation on digital signal processor chips.

9 Claims, 3 Drawing Sheets

REDUCING SEARCH COMPLEXITY FOR CODE-EXCITED LINEAR PREDICTION (CELP) CODING

This invention relates to code-excited linear prediction (CELP) coding of speech and is particularly concerned with reducing searching complexity for codebooks.

Background of the Invention

Public land-mobile telephone systems are expected to use speech coding at 16 kbit/s or 8 kbit/s in a forward adaptive mode so that the reconstructed speech quality will be insensitive to bit and frame errors. Speech frames of 10 to 20 ms are under consideration as the size of segment to be coded at one time. Shorter segments generally require higher bit-rates, and thereby prevent the inclusion of error detection and correction bits in the available bit budget. Available standards at 16 kbit/s use a very short segment (0.625 ms) to achieve wire line (toll) quality. However, the proposed speech frames of 10–20 ms impose a huge computational burden through the codebook searching. Various techniques have been proposed to reduce this computational burden. These include temporal subdivision of the residual signal into sub frames and individually encoding the signal in each subframe. When the subframe becomes short, the procedure may be sub optimal because selection of a code vector for one subframe influences the selection of the next subframe. In other words, the sub frames are not independent of one another.

Summary of the Invention

An object of the present invention is to provide an improved method and apparatus for reducing search complexity for code-excited linear prediction (CELP) coding.

In accordance with a further aspect of the present invention there is provided in a CELP speech coding and decoding system for transmission of a PCM speech signal on a frame-by-frame basis, a speech coder comprising an input for PCM speech signal, means for short-term LPC analyzing the speech signal to provide short-term LPC filter parameters, means for LPC inverse filtering the speech signal using the short-term LPC filter parameters to produce a residual signal, means for long-term filter analyzing the residual signal to determine a long-term periodicity parameter, means for quadrature mirror filter (QMF) analyzing the residual signal to produce a plurality of band-passed residual signals, a plurality of long-term filter gain means, one for each of a respective one of the plurality of band-passed residual signals, for producing a corresponding plurality of long-term filter gain values, and a plurality of codebook means, one for each of a respective one of the plurality of band-passed residual signals for providing a codebook index value for a vector representative of the band-passed residual signal and a codebook gain value in dependence upon the band-passed residual signal and the long-term filter gain, respectively.

In an embodiment of the present invention each of the plurality of codebook means has a size $2^n$ where n is an integer and n increases with decreasing frequency of its respective band-passed residual signal.

An advantage of the present invention is the reduction of search complexity by providing a codebook for each band whose accuracy is dependent upon that required for the band to reproduce with the desired quality.

In accordance with another aspect of the present invention there is provided in a CELP speech coding and decoding system for transmission of a PCM speech signal on a frame-by-frame basis, a speech decoder comprisings inputs for receiving short-term LPC filter parameters, a long-term periodicity parameter, a plurality of long-term filter gain values, and a corresponding plurality of codebook index values and codebook gain values, a plurality of codebook reference means, one for each respective received codebook index value, each for providing a vector representative of the band-passed residual signal, a plurality of variable gain amplifier means, each connected to a respective codebook, and responsive to a respective received codebook gain value, a plurality of adder means, each for adding a respective zero-input to an output of a respective variable gain amplifier means, for producing a plurality of reconstructed band-passed residual signals, quadrature mirror filter (QMF) synthesizing means for combining the plurality of reconstructed residual signals to produce a reconstructed residual signal, and means for LPC filtering the reconstructed residual signal using the received short-term LPC filter parameters to produce a reconstructed speech signal.

In another embodiment of the present invention each of the plurality of codebook reference means has a size $2^n$where n is an integer and n increases with decreasing frequency of its respective band-passed residual signal.

In accordance with a further aspect of the present invention there is provided in a CELP speech coding and decoding system for transmission of a PCM speech signal on a frame-by-frame basis, a coding method comprising inputting a PCM speech signal, short-term LPC analyzing the speech signal to provide short-term LPC filter parameters, LPC inverse filtering the speech signal using the short-term LPC filter parameters to produce a residual signal, long-term filter analyzing the residual signal to determine a long-term periodicity parameters quadrature mirror filter (QMF) analyzing the residual signal to produce a plurality of band-passed residual signals, long-term filter analyzing gain for each of a respective one of the plurality of band-passed residual signals, for producing a corresponding plurality of long-term filter gain values, and providing a codebook index value for a vector representative of the band-passed residual signal and a codebook gain value in dependence upon the band-passed residual signal and the long-term filter gain, respectively.

BRIEF DESCRIPTION OF THE DRAWINGS

The present invention will be further understood from the following description with reference to the drawings in which.

Similar references are used in different figures to denote similar components.

DETAILED DESCRIPTION

Figure 1:
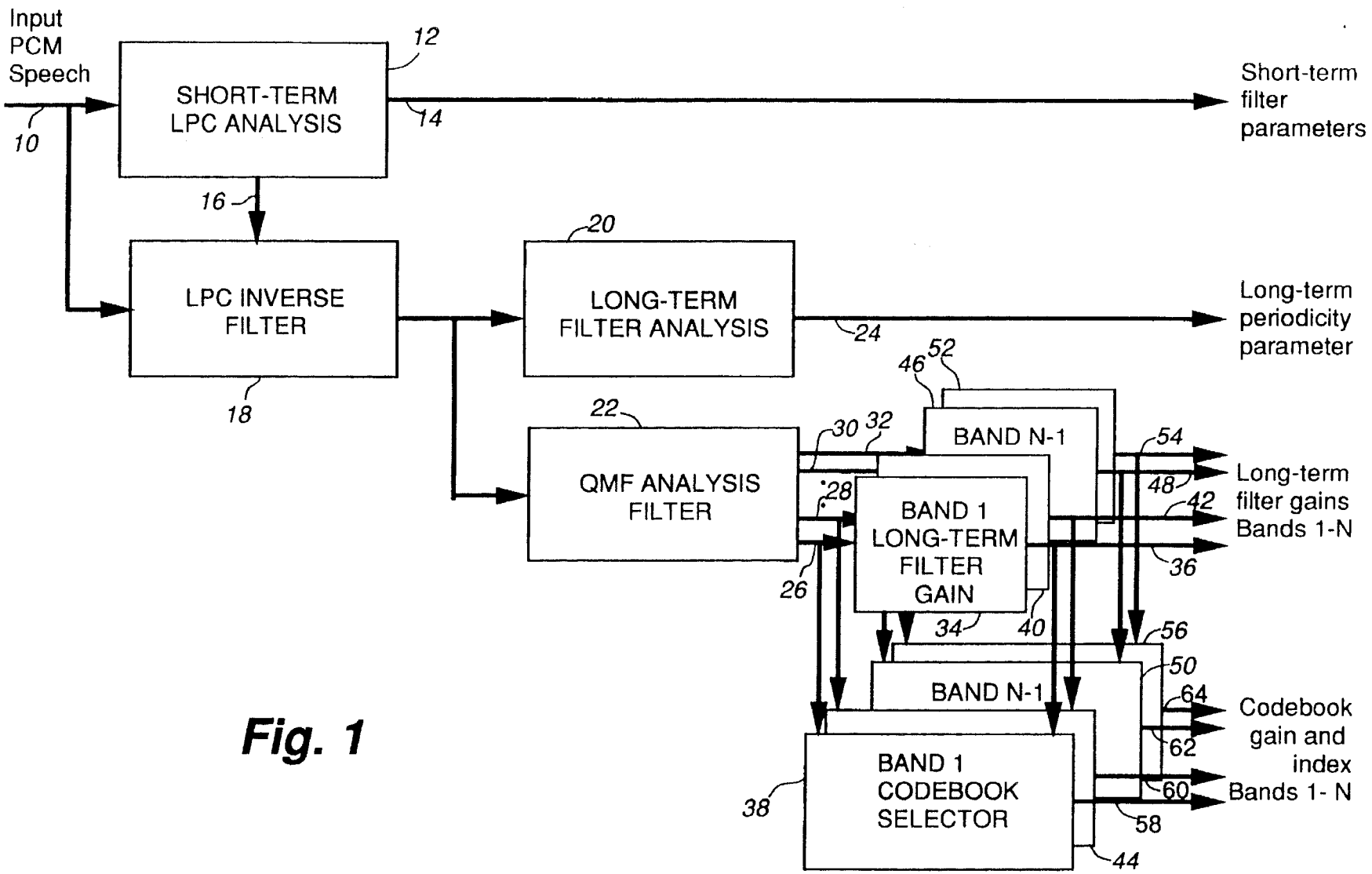
FIG. 1 illustrates, in a block diagram, a CELP speech coder in accordance with an embodiment of the present invention.

Referring to FIG. 1, there is illustrated in a block diagram, a CELP encoder in accordance with an embodiment of the present invention. The encoder includes an input 10, for PCM speech, connected to a short-term (linear predictor coding) LPC analyzer 12, $A(z)=\Sigma_i a_i z^{-i}$, having outputs 14 and 16 for parameters $a_i$. The output 14 is connected via transmission facilities to a remote decoder (not shown in FIG. 1). The output 16 is connected to an LPC inverse filter 18, 1/A(z). The LPC inverse filter 18 has its output connected to a long-term filter analyzer 20, $B(z)=Bz^{-M}$, and to a quadrature mirror filter (QMF) analysis filter 22. The long-term filter analyzer 20 has an output 24 connected via transmission facilities to the remote decoder.

The QMF analysis filter 22 has N outputs as represented by four outputs 26, 28, 30, and 32. The output 26 for band 1 is connected to a respective long-term filter gain block 34 having an output 36 and to a band-passed codebook selector 38. Similarly, the outputs 28, 30, and 32, for bands 2, 3 and 4, respectively, are connected to a long-term filter gain block 40 having an output 42 and to a band-passed codebook selector 44, a long-term filter gain block 46 having an output 48 and to a band-passed codebook selector 50 and a long-term filter gain block 52 having an output 54 and to a band-passed code selector 56, respectively.

In operations a PCM coded speech frame is analyzed by the short-term LPC analyzer to determine LPC filter parameters. These LPC parameters are provided to the remote encoder via the output 14 and to the LPC inverse filter 18 via the output 16. The LPC inverse filter 18 uses the filter parameters provided to inverse filter the PCM coded speech frame to produce a residual signal. The residual signal is input to both the long-term filter analyzer 20 and the QMF analysis filter 22. The long-term filter analyzer 20 provides long-term filter delay via the output 24. The QMF analysis filter divides the residual signal into band-passed residual signals for bands 1, 2, 3, and 4 provided at outputs 26, 28, 30, and 32, respectively.

A codebook selector is provided for each band. The codebook selectors 38, 44, 50, and 56 select the codebook entry providing the best match to the residual signal for their respective band and send codebook index and gain values to the decoder via outputs 58, 60, 62, and respectively.

Figure 2:
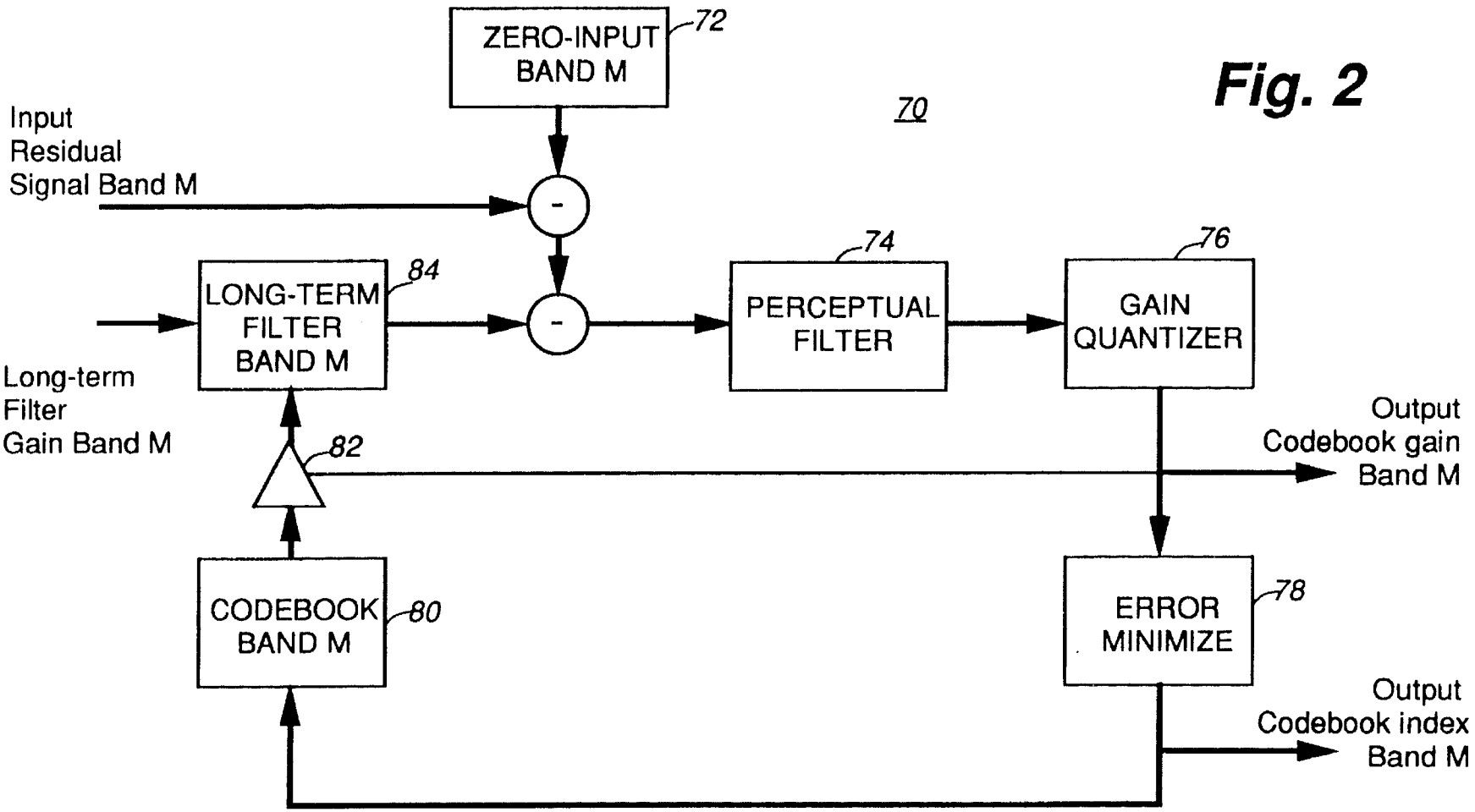
FIG. 2 illustrates, in a block diagram, detail of a codebook selector of FIG. 1.

For simplicity of the description, the codebook selector for a single band M is described in further detail with regard to FIG. 2. Each of the codecook selectors 38, 44, 50, and 56 has a similar configuration. The codebook selector 70 for band M includes a buffer 72 for zero input, a perceptual filter 74, a gain quantizer 76, an error minimization block 78, a codebook 80, a variable gain amplifier 82, and a long-term filter 84.

Selection of the codebook entry is based on the output of the respective perceptual filter. In turn, each codebook entry is multiplied by the codebook gain parameter in the variable gain amplifier 82, passed through the long-term filter 84 and combined with the zero-input signal arising from the previous signals generated in the band, stored in the buffer 72 and the residual signal for band M from the QMF filter. The difference signal is passed through the perceptual filter 74. The output energy of the perceptual filter 74 is computed for each codebook entry by the error minimization block 78 and the one with minimum energy is selected and its index is transmitted to the decoder.

Each codebook selector 38, 44, 50, and 56 operates generally as do known CELP codebook searches. However, because of the band-pass filters provided by the QMF analysis filter 22, the total perceptually weighted error can be regarded as the sum of the errors in the N sub-bands, each weighted by the relative gain of the perceptual filter. To match a selected segment of the input residual, the four codebooks are searched in turn, ordered according to increasing frequency of the band-passed components. The codebooks may be populated by band-passed Gaussian signals or by vectors resulting from training through analysis of natural speech. Such techniques for training codebooks are well-known. The size of the codebooks can be reduced for two reasons. First, the lower band-passed bands are sampled at correspondingly lower rates, and second, the accuracy of the higher band-passed codebook can be decreased because of the relative insensitivity of human hearing to errors in the residual signal with increasing frequency.

Figure 3:
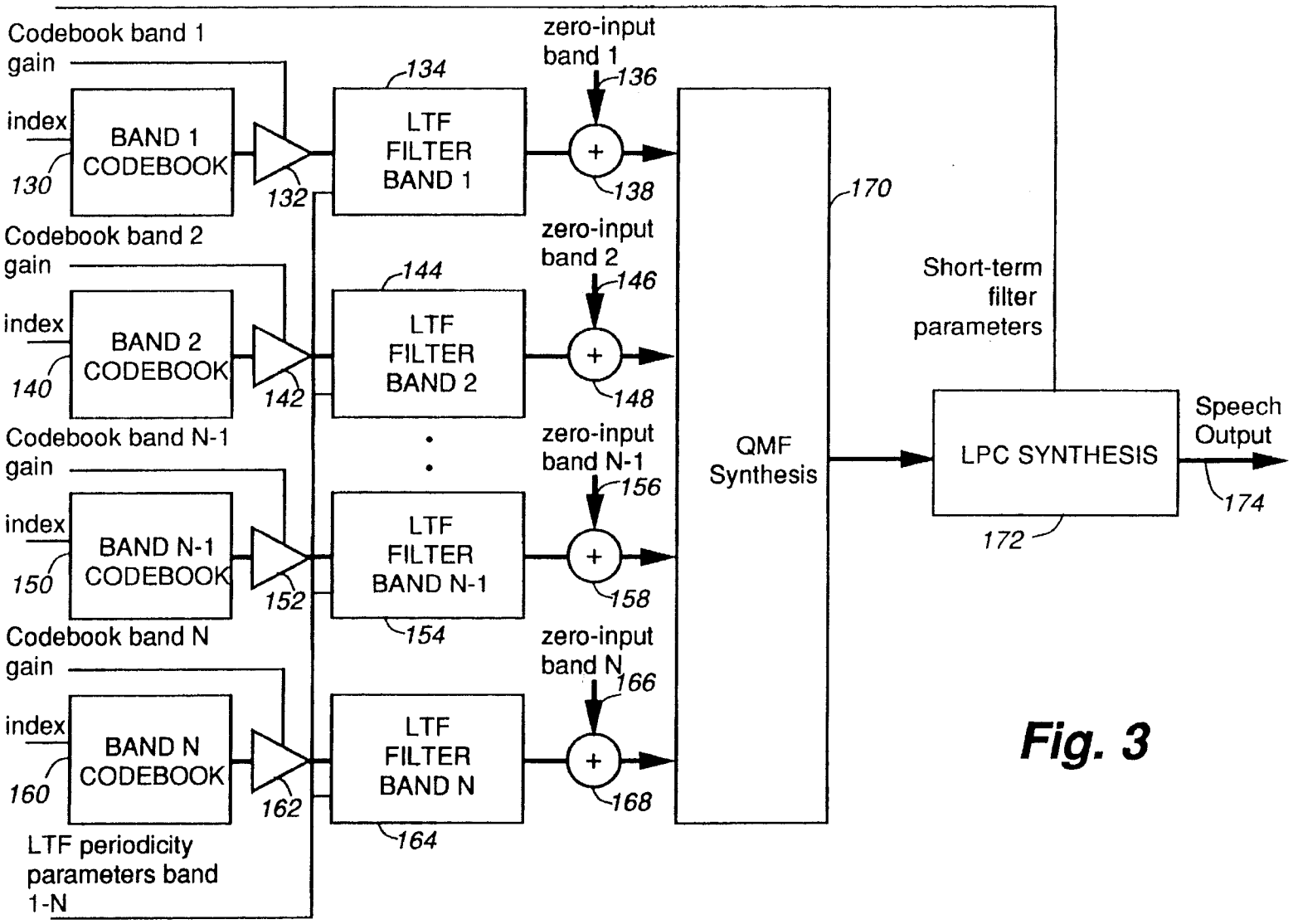
FIG. 3 illustrates, in a block diagram, a CELP speech decoder in accordance with an embodiment of the present invention.

Referring to FIG. 3, there is illustrated in a block diagram, the CELP speech decoder in accordance with an embodiment of the present invention. For each of N bands, the decoder includes a codebook, a variable-gain amplifier, a long-term filter and a summation with a zero-input signal. Thus band 1 includes a codebook 130, a variable gain amplifier 132, a long-term filter 134, a band 1 zero-input 136 and an adder 138. Similarly, band 2 includes a codebook 140, a variable gain amplifier 142, a long-term filter 144, a band 2 zero-input 146 and an adder 148, band N-1 includes a codebook 150, a variable gain amplifier 152, a long-term filter 154, a band N-1 zero-input 156 and an adder 158 and band 4 includes a codebook 160, a variable gain amplifier 162, a long-term filter 164, a band N zero-input 166 and an adder 168. The outputs of adders 138, 148, 158, and 168 are connected to a QMF synthesis block 170. The output of the QMF synthesis block 170 is input to an LPC synthesis block 172 having an output 174 for decoded speech.

In operation, the codebook indexes received from the encoder of FIG. 1 are input to respective codebooks 130, 140, 150, and 160 to retrieve the codebook entries for bands 1, 2, N-1, and N, respectively. These codebook entries are passed through the variable gain amplifiers 132, 142, 152, and 162, respectively, to adjust their gains in accordance with respective gain values received from the encoder of FIG. 1. The gain adjusted codebook entries are then passed through respective long-term filters 134, 144, 154, and 164 which use respective long-term periodicity parameter and gain as received from the encoder of FIG. 1. The restored residual signals output from the long-term filters 134, 144, 154, and 164 are combined with respective zero-input signals before being recombined into a full bandwidth residual signal by the QMF synthesis block 170. The residual signal passes through the LPC synthesis block 172 to form a decoded speech signal at the output 174 based on the short-term filter parameters $a_i$ received from the encoder of FIG. 1.

Perceptual filter weights lower frequency more than higher frequency because it mimics the human hearing response to frequency. Frequency weighting has been found to be appropriately applied to the residual signal. It is therefore appropriate to apply such weighting by subdividing the bandwidth of the residual signal into sub-bands, then establishing $2^n$ value codebooks for each sub-band with n increasing with decreasing frequency. In a particular embodiment of the present invention, for example, the codebook values are $2^8$, $2^6$, $2^2$, and $2^0$, for bands of 0–1 kHz, 1–2 kHz, 2–3 kHz, and 3–4 kHz, respectively. In addition to the reduction in transmission bit rate provided by varying the number of levels in the codebook of a given band, a decreased sampling rate with decreasing bandwidth allows a faster search through each codebook.

This results in faster searching, which is important as the available processing capacity for currently available signal processor chips limits the size of codebook that can be searched in real time.

Subdividing the codebook along spectral bands preserves the optimality without increasing the complexity of the search process. After appropriate decimation, four codebooks each containing vectors of ¼ the original length, are searched instead of one codebook with longer entries.

The advantages of searching band-passed codebooks arise from the observation that the human listener is less sensitive to coding errors in the residual signal in the higher frequencies. Therefore, smaller codebooks suffice to encode the higher frequency components of the residual than the lowest frequency band. This results in savings, both in transmission rate as well as encoding complexity.

An additional advantage of the use of multiple band-passed residual codebooks is the improved robustness to transmission errors. A transmission error in one codevector bit will result in band-passed residual noise for one frame rather than full-band noise for one subframe. When the code vector bits are not protected by forward error coding, the quality of the reconstructed speech is thus improved for the same bit error rate.

Numerous modifications, variations and adaptations may be made to the particular embodiments of the invention described above without departing from the scope of the invention, which is defined in the claims.

What is claimed is:

1. In a CELP speech coding and decoding system for transmission of a PCM speech signal on a frame-by-frame basis, a speech coder comprising:

means for inputting a PCM speech signal;

means for short-term LPC analyzing the speech signal to generate short-term LPC filter parameters;

means for LPC inverse filtering the speech signal using the short-term LPC filter parameters to produce a residual signal;

means for long-term filter analyzing the residual signal to generate long-term filter delay;

means for quadrature mirror filter (QMF) analyzing the residual signal to produce a plurality of band-passed residual signals;

a plurality of long-term filter gain means, one for each of a respective one of the plurality of band-passed residual signals, for producing a corresponding plurality of long-term filter gain values; and a plurality of codebook means, one for each of a respective one of the plurality of band-passed residual signals for generating a codebook index value for a vector representative of the band-passed residual signal and a codebook gain value in dependence upon the band-passed residual signal and the long-term filter gain, respectively.

2. A speech coder as claimed in claim 1 wherein each of the plurality of codebook means has a size $2^n$ where n is an integer and n increases with decreasing frequency of the respective band-passed residual signal of the codebook means.

3. A speech coder as claimed in claim 2 wherein the plurality of codebook means comprises four codebooks.

4. A speech coder as claimed in claim 3 wherein the size of the four codebooks is $2^8$, $2^6$, $2^2$, and $2^0$ in order of increasing respective band frequency.

5. In a CELP speech coding and decoding system for transmission of a PCM speech signal on a frame-by-frame basis, a speech decoder comprising:

inputs for receiving short-term LPC filter parameters, long-term filter delay, a plurality of long-term filter gain values, and a corresponding plurality of codebook index values and codebook gain values;

a plurality of codebook reference means, one for each respective received codebook index value, each for generating a vector representative of the band-passed residual signal;

a plurality of variable gain amplifier means, each connected to a respective codebook, and responsive to a respective received codebook gain value;

a plurality of adder means, each for adding a respective zero-input to an output of a respective variable gain amplifier means, for producing a plurality of reconstructed band-passed residual signals;

quadrature mirror filter (QMF) synthesizing means for combining the plurality of reconstructed residual signals to produce a reconstructed residual signal; and means for LPC filtering the reconstructed residual signal using the received short-term LPC filter parameters to produce a reconstructed speech signal.

6. A speech decoder as claimed in claim 5 wherein each of the plurality of codebook reference means has a size $2^n$ where n is an integer and n increases with decreasing frequency of the respective band-passed residual signal of the codebook reference means.

7. A speech decoder as claimed in claim 6 wherein the plurality of codebook reference means comprises four codebooks.

8. A speech decoder as claimed in claim 7 wherein the size of the four codebooks is $2^8$, $2^6$, $2^2$, and $2^0$ in order of increasing respective band frequency.

9. In a CELP speech coding and decoding system for transmission of a PCM speech signal on a frame-by-frame basis, a coding method comprising:

inputting a PCM speech signal;

short-term LPC analyzing the speech signal to generate short-term LPC filter parameters;

LPC inverse filtering the speech signal using the short-term LPC filter parameters to produce a residual signal;

long-term filter analyzing the residual signal to generate long-term filter delay;

quadrature mirror filter (QMF) analyzing the residual signal to produce a plurality of band-passed residual signals;

long-term filter analyzing gain for each of a respective one of the plurality of band-passed residual signals, for producing a corresponding plurality of long-term filter gain values; and generating a codebook index value for a vector representative of the band-passed residual signal and a codebook gain value in dependence upon the band-passed residual signal and the long-term filter gain, respectively.

* * * * *